US005289083A

United States Patent [19]

Quazi

[11] Patent Number: 5,289,083

[45] Date of Patent: Feb. 22, 1994

[54] RESONANT INVERTER CIRCUITRY FOR EFFECTING FUNDAMENTAL OR HARMONIC RESONANCE MODE STARTING OF A GAS DISCHARGE LAMP

[75] Inventor: Fazle S. Quazi, Boulder, Colo.

[73] Assignee: Etta Industries, Inc., Boulder, Colo.

[21] Appl. No.: 715,749

[22] Filed: Jun. 18, 1991

Related U.S. Application Data

[63] Continuation of Ser. No. 332,055, Apr. 3, 1989, abandoned.

[51] Int. Cl.[5] ..... H05B 39/04

[52] U.S. Cl. ..... 315/224; 315/243; 315/244; 315/284; 315/311; 315/DIG. 7; 315/DIG. 2; 315/362

[58] Field of Search ..... 315/224, 243, 244, 284, 315/311, DIG. 7, DIG. 2, 362

[56] References Cited

U.S. PATENT DOCUMENTS

| | | | |
|---|---|---|---|
| 3,611,021 | 10/1971 | Wallace | 315/307 |
| 3,882,356 | 5/1975 | Stehlin | 315/DIG. 7 |
| 4,053,813 | 10/1977 | Kornrumpf et al. | 315/244 |
| 4,127,798 | 11/1978 | Anderson | 315/DIG. 5 |
| 4,237,403 | 12/1980 | Davis | 315/DIG. 5 |
| 4,348,615 | 9/1982 | Garrison et al. | 315/DIG. 7 |
| 4,399,391 | 8/1983 | Hammer et al. | 315/244 |
| 4,544,863 | 10/1985 | Hashimoto | 315/244 |
| 4,613,934 | 9/1986 | Pacholok | 315/DIG. 7 |
| 4,631,450 | 12/1986 | Lagree et al. | 315/244 |
| 4,647,817 | 3/1987 | Fähnrich et al. | 315/244 |
| 4,730,147 | 3/1988 | Kroening | 315/224 |
| 4,864,482 | 9/1989 | Quazi et al. | 363/37 |
| 4,933,605 | 6/1990 | Quazi et al. | 315/224 |
| 4,943,886 | 7/1990 | Quazi et al. | 361/42 |

FOREIGN PATENT DOCUMENTS

| | | |
|---|---|---|
| 0259646 | 3/1988 | Fed. Rep. of Germany . |
| 3632272 | 4/1988 | Fed. Rep. of Germany . |

OTHER PUBLICATIONS

Hayt, Jr. et al. "Engineering Circuit Analysis" Third Ed. 1978 pp. 296–297.

*Primary Examiner*—Robert J. Pascal
*Assistant Examiner*—Michael B. Shingleton
*Attorney, Agent, or Firm*—Sixbey, Friedman, Leedom & Ferguson

[57] ABSTRACT

The invention relates to an inverter powering a lamp that uses a switch to vary the resonance of the resonance circuit for starting and for operating.

7 Claims, 8 Drawing Sheets

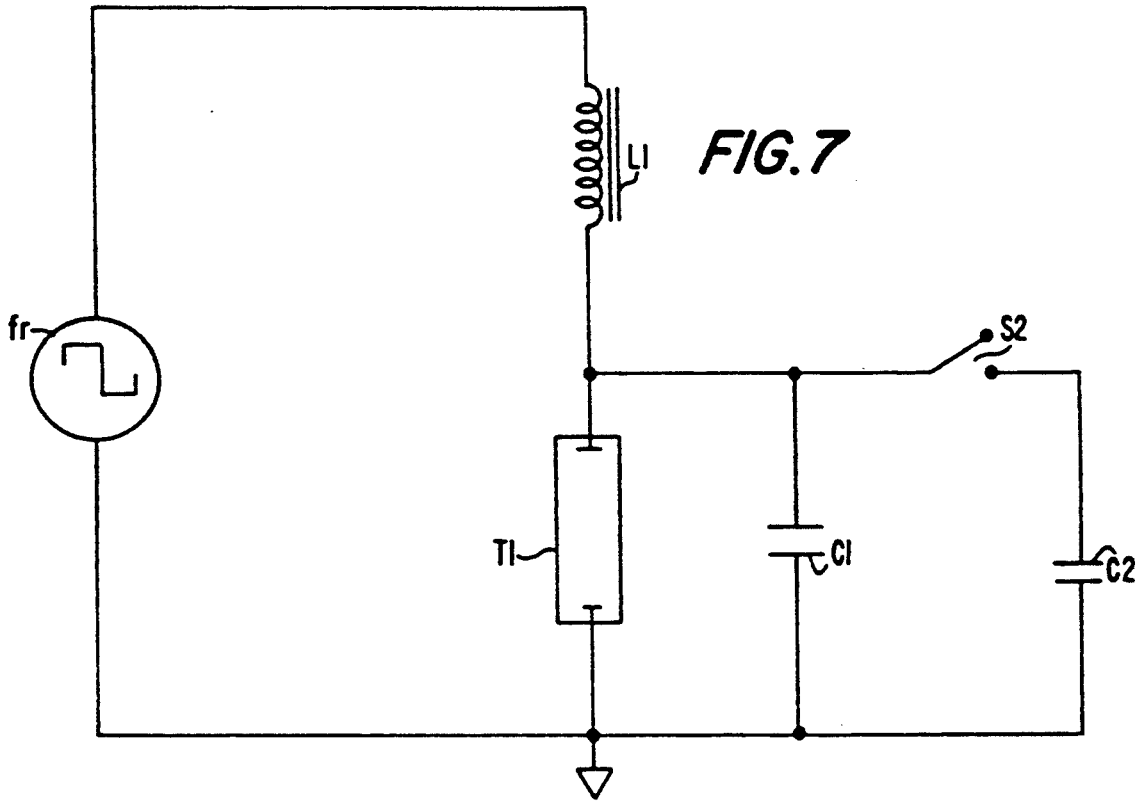
FIG. 7
FIG. 8
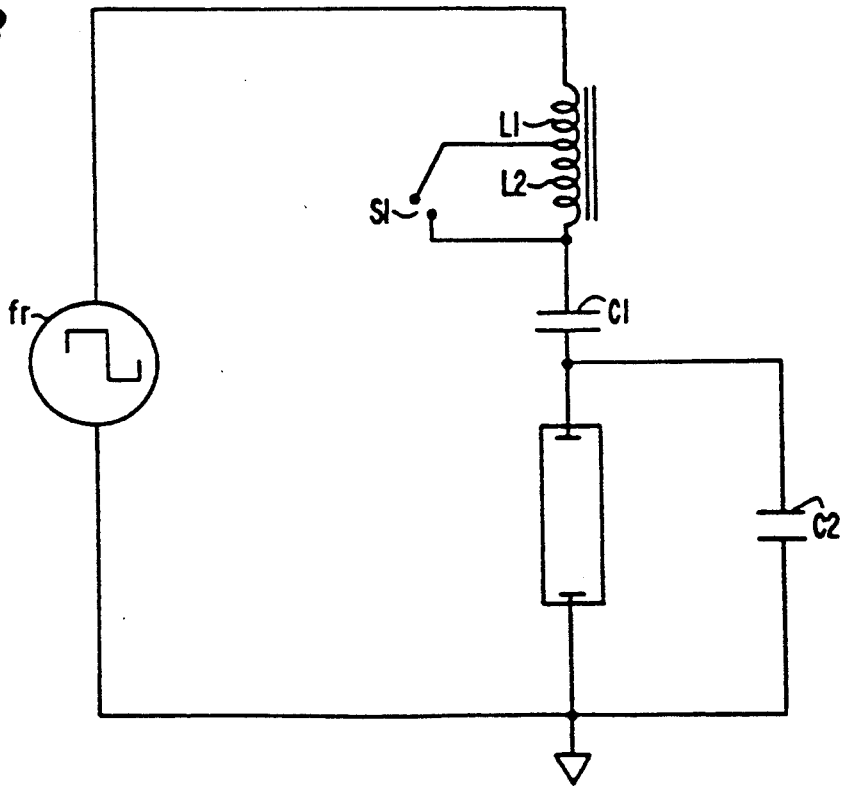

RESONANT INVERTER CIRCUITRY FOR EFFECTING FUNDAMENTAL OR HARMONIC RESONANCE MODE STARTING OF A GAS DISCHARGE LAMP

This application is a continuation of Ser. No. 07/332,055, filed Apr. 3, 1989, now abandoned.

RELATED PATENT APPLICATIONS

This application is related to U.S. Pat. Nos. 4,933,605 and 4,864,482, and U.S. Pat. No. 4,943,886, all of the foregoing patents being assigned to the assignee of the present application and being incorporated herein by reference.

BACKGROUND OF THE INVENTION

This invention relates to circuitry which may utilize the resonance phenomenon to ignite and/or to operate a gas discharge lamp.

Gas discharge lamps, for example, fluorescent lamps, high pressure sodium lamps, neon signs, etc., usually require high voltages to fire. But, once they are ignited, the operating voltages are significantly lower. It is disclosed in above-mentioned U.S. Pat. No. 4,933,605 how a high frequency resonant inverter can very efficiently ignite and operate a gas discharge lamp.

A block diagram of a resonant inverter utilizing the integrated circuit (IC) SG2525 is shown in FIG. 1. The combination of CT2 and RT2 determines the oscillator frequency of the IC. A resistor R4 is usually required between the terminal 15 and 13. A resistor divider R5 and R6 determines the amount of DC voltage applied to non inverted terminal (pin 2) of the operational amplifier. This voltage, in turn, sets the magnitude of the duty cycle of the output pulses (pin 14 and pin 11). Depending on the requirement, an impedance Z2 is necessary between the inverted terminal (pin 1) and the compensation terminal (pin 9) of the error amplifier for loop stability of the IC.

Output signals from pin 11 and pin 14 periodically turn Q2 and Q3 on and off. Thus, when Q2 is on, Q3 is off, and when Q2 is off, Q3 is on. During the time when Q2 is on, energy flows through Q2 and the resonant inductor LR to charge the resonant capacitor CR. Then, when Q2 is off but Q3 is on, stored energy from CR flows back through LR and Q3. With this arrangement, if the pulse repetition frequency is identical with the resonance frequency of the LC (LR and CR) network, the circuit can be described as a resonant inverter.

One of the simplest, most efficient and economical ballast configurations based on a resonant converter technique is shown in FIG. 2.

In this case LR and CR form a resonant circuit and the lamp T1 acts like a load across CR. This is equivalent to the diagram of FIG. 3. The respective impedances of the circuit parameters of FIG. 3 can be described as follows: For the load, the impedance is RL, for the resonant capacitor, the impedance is $1/jw(CR) = -jXCR$ and for the resonant inductor, the impedance is $jw(LR) = jXLR$. Here, j is the complex number and $w = 2\pi(fr) = x$. fr is the excitation frequency. At resonance, XCR=XLR. Further, $$fr = 1/w\sqrt{(LR.CR.)}$$

In the case of FIG. 3, under the resonance condition, the voltage across CR or RL depends on the quality or Q-factor of LR and CR, and value of RL. This is true because, at resonance, $jXLR - jXCR = \phi$, that is, the impedances offered by the inductor and the capacitor are mutually cancelled. In the present application, RL is replaced by the lamp T1. Initially, before the lamp T1 fires, it offers an infinite impedance (that is, no current flow therethrough) and as a result the voltage across CR or T1 (FIG. 2) continues to grow. However, once the voltage across T1 reaches the lamp firing potential, the lamp T1 fires and offers much lower impedance. At this instance, due to the lamp chracteristic, the voltage across T1 clamps down to the normal lamp operating potential and stays there. This is a very convenient and reliable mechanism for starting and operating a fluorescent lamp.

During the normal operation, the current through the resonant inductor LR is equal to the vector sum of the current through the resonant capacitor CR and the current through the load or the lamp T. This is true, because, during the normal operation the lamp T can be considered mostly a resistive load and, as a result, the current through the capacitor CR will have 90 degree phase difference, with respect to the lamp current. Thus, the current through LR, which is also the total circuit current, can be described as, $$i_{LR} = i_{Total} = \sqrt{(i^2_{\text{lamp}} + i^2_{CR})}$$

Further, during normal operation, the voltage across the resonant capacitor is the same as the voltage across the lamp, $V_{\text{lamp}}$. Thereby, the current through CR is, $i_{CR,\text{ running}} = V_{\text{lamp}}/XCR$. On the other Hand, during starting, before the lamp fires, the current through the capacitor CR is determined by the ratio of the lamp firing potential to the impedance of CR. That is, $$i_{CR,\text{ firing}} = \frac{V_{\text{lamp, firing}}}{XCR}$$

Moreover, during starting, $i_{CR,\text{ firing}}$ equals the total load current, which is circulating between CR and LR through the power switches Q2 and Q3. For this reason, if the lamp firing potential is very high, depending on XCR, a very large amount of circulating current can flow through Q2 and Q3 before the lamp fires. This large circulating current during starting may exceed the maximum rated current through Q2 and Q3 and thereby, may destroy Q2 and Q3.

SUMMARY OF THE INVENTION

Accordingly, it is a primary object of this invention to provide resonant inverter circuitry for effecting fundamental or harmonic resonance mode starting of a gas discharge lamp such that the maximum current rating of the power switches of the resonant inverter is not exceeded.

Another primary object of the invention is provide harmonic mode starting of a gas discharge lamp to facilitate firing thereof.

These and other objects of the invention will be apparent from a reading of the following specification and claims taken with the drawing.

BRIEF DESCRIPTION OF THE DRAWING

FIG. 7 is a circuit diagram of a further illustrative embodiment of the invention utilizing harmonic mode starting and fundamental resonance mode operation.

FIG. 8 is a circuit diagram of a further illustrative embodiment of the invention utilizing resonance mode starting and series resonance mode operation.

DETAILED DESCRIPTION OF PREFERRED EMBODIMENT OF THE INVENTION

Figure 1:
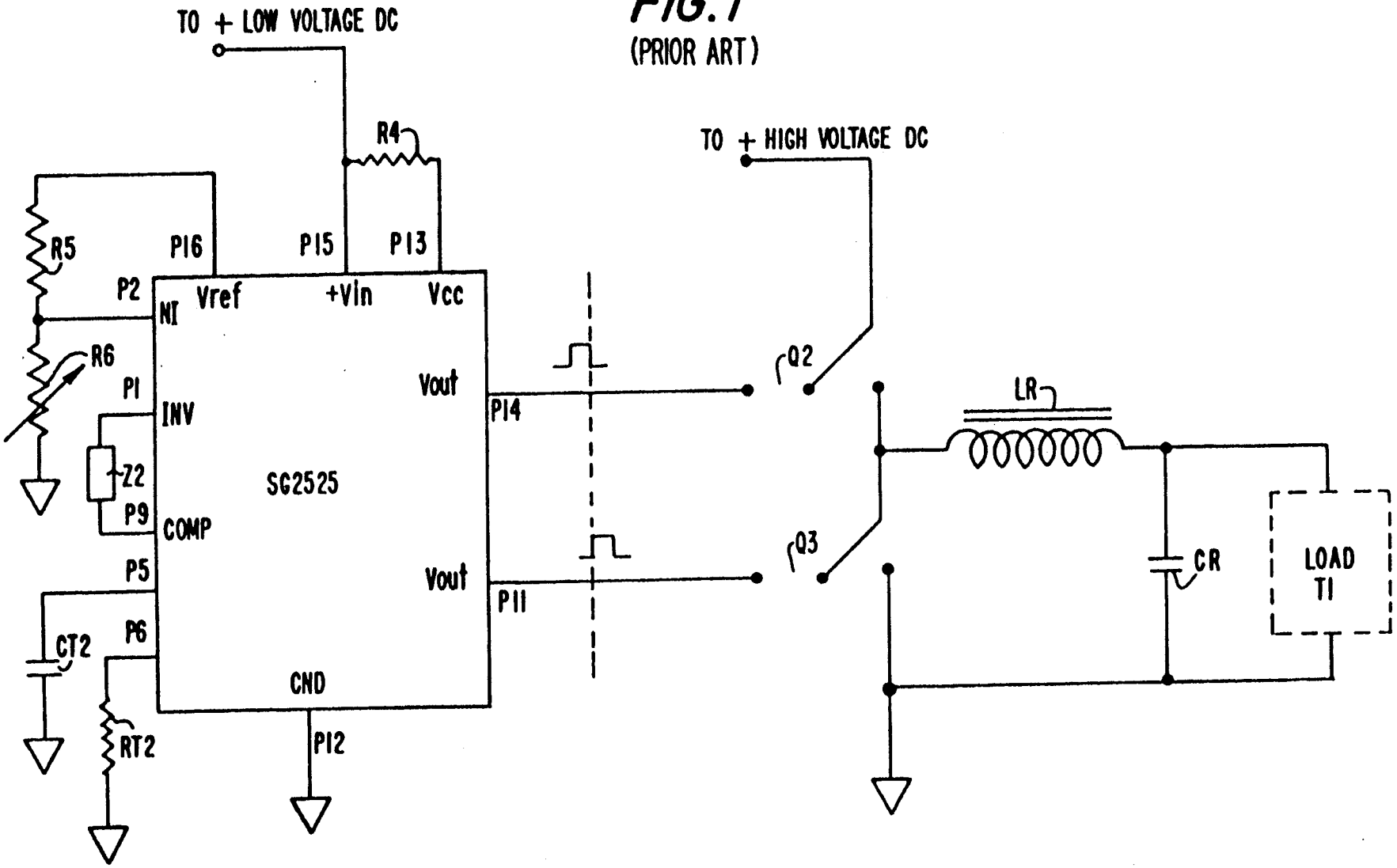
FIG. 1 (PRIOR ART)
FIG. 1 is a combined schematic and block diagram of a resonant inverter in accordance with the prior art.

Reference should be made to the drawing where like reference numerals refer to like circuit elements and where several embodiments of circuitry are described for starting and operating gas discharge lamps utilizing fundamental and harmonic resonance modes.

Figure 4:
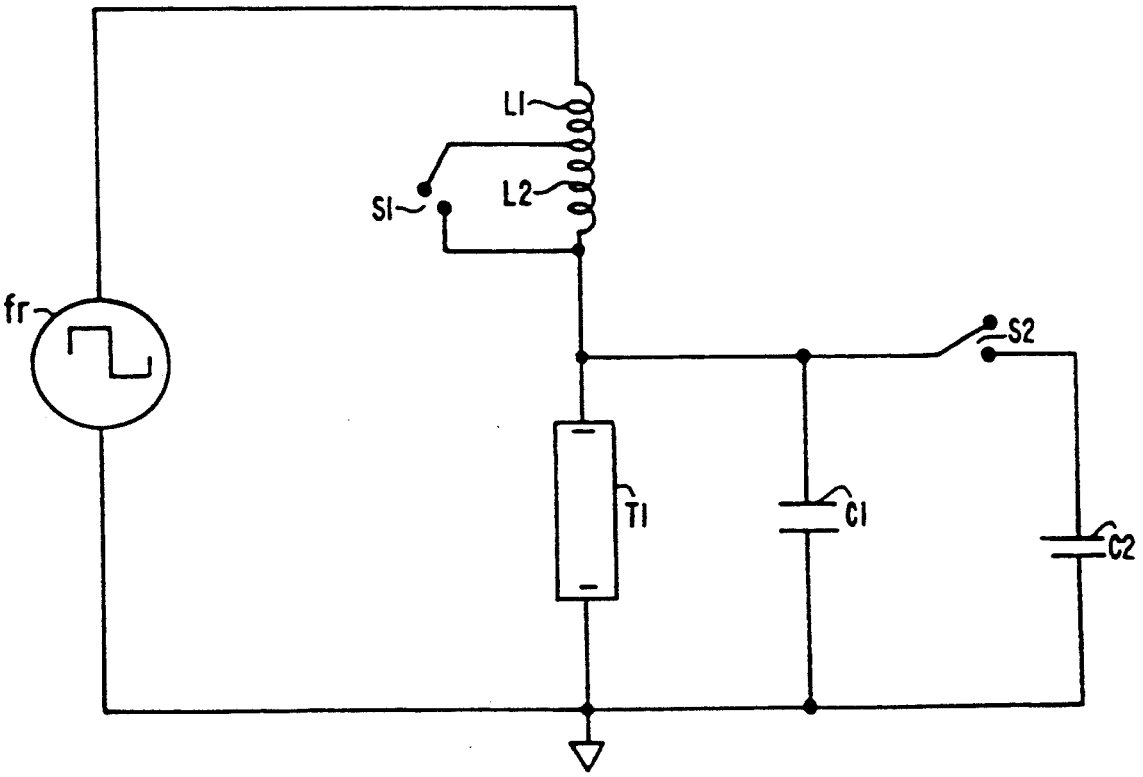
FIG. 4 is a schematic diagram of a first illustrative embodiment of the invention utilizing resonance mode starting at the fundamental frequency of the excitation signal and parallel resonance mode operation also at the fundamental frequency of the excitation signal.

In a first embodiment as illustrated in FIG. 4, resonance mode starting (at the fundamental frequency (fr) of the excitation signal) and parallel resonance mode operation (also at the fundamental frequency fr) are effected utilizing two separate inductors, L1, L2, or a single inductor with two sections L1 and L2 connected to a lamp T1 and capacitors C1 and C2. C1 is much smaller than C2. Moreover, (L1+L2) C1=L1 (C1+C2). Excitation frequency (fr) is the same as the natural resonance frequency of (L1+L2) C1=L1 (C1+C2) combinations. During normal operation (after the lamp has fired), the switches S1 and S2 are closed and thus the L1 (C1+C2) combination is utilized. In this case, as explained earlier, $$i_{LR} = i_{Total} = \sqrt{(i^2_{Lamp} + i^2_{CR})}\text{, and}$$

-continued $$i_{CR} = \frac{V_{lamp}}{X(C1 + C2)}$$

Figure 2:
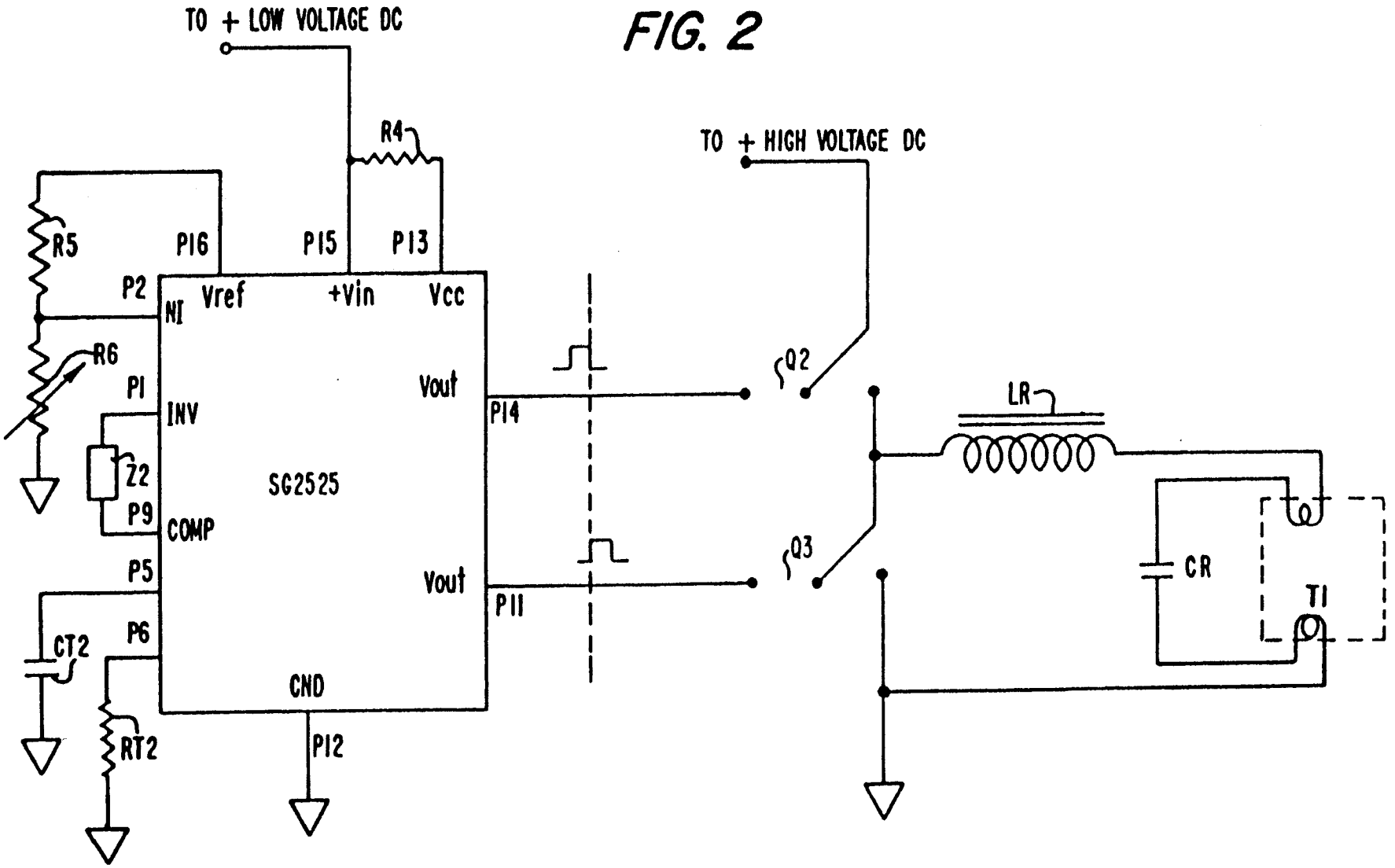
FIG. 2 is a combined block and schematic diagram of a resonant inverter for use with a gas discharge lamp or the like, the foregoing circuitry being described in U.S. Pat. No. 4,933,605.
Figure 3:
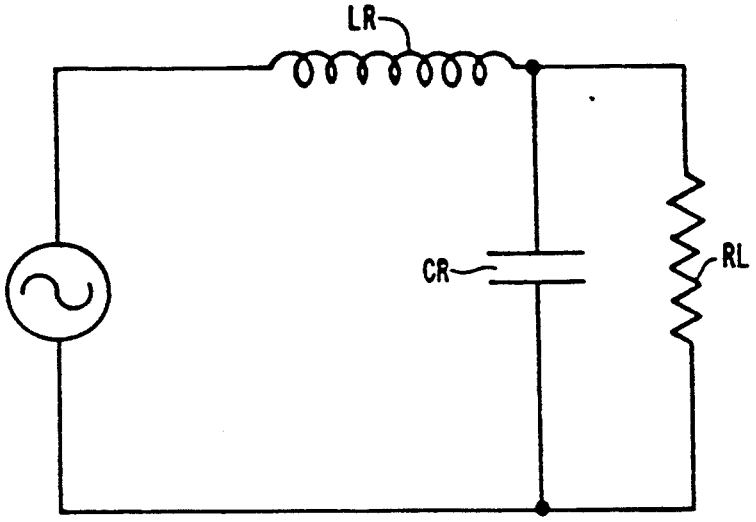
FIG. 3 is an equivalent schematic diagram of the resonant circuit and gas discharge lamp of FIG. 2.

On the other hand, during starting (that is, before firing)

$$i_{CR,\,firing} = \frac{V_{lamp,\,firing}}{XC1}$$

since the (L1+L2) C1 combination is used at this time. Since C1 is much smaller than C2, the impedance offered by C1 is much greater than the impedance offered by (C1+C2), for the same excitation frequency (fr). As a result, during starting while S1 and S2 are open, the current through the capacitor C1 can be made very small while voltage across T1 reaches the firing potential. Hence, the current circulating through the inverter circuit including power switches Q2 and Q3 (FIG. 2) is maintained, during starting, at a value less than the maximum ratings of Q2 and Q3.

Figure 6:
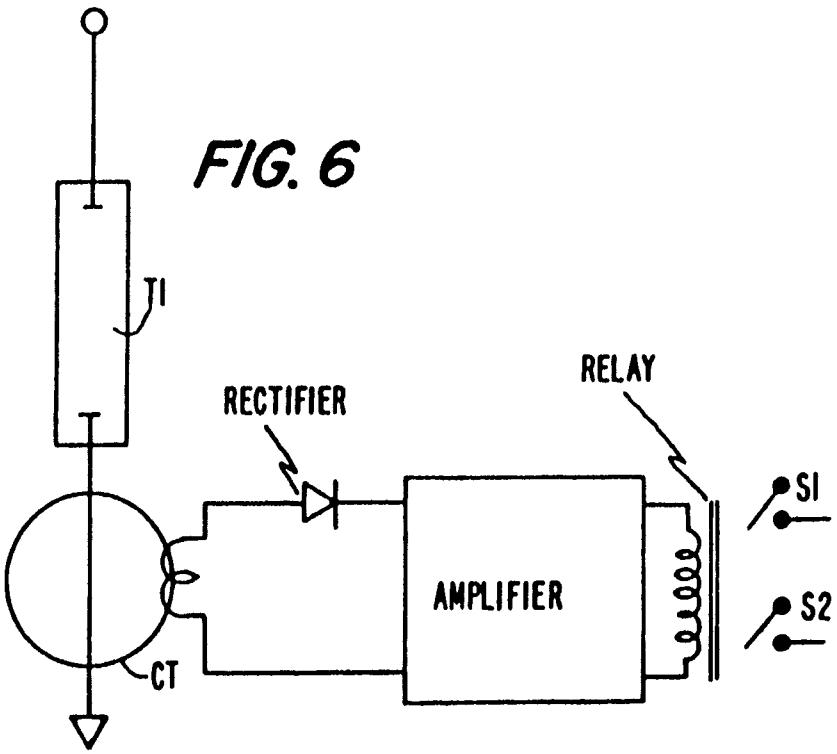
FIG. 6 is a circuit diagram of a second illustrative current sensing circuit for use with the circuitry of FIG. 4.
Figure 5:
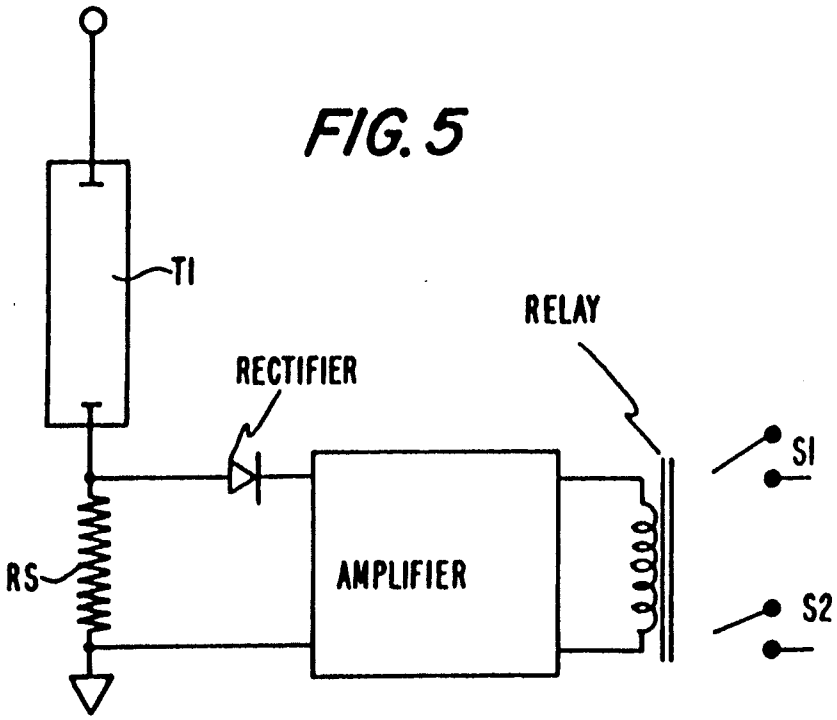
FIG. 5 is a schematic diagram of a first illustrative current sensing circuit for use with a circuitry of FIG. 4.

After the lamp fires, the switches S1 and S2 are closed by, for example, sensing current through the lamp and then this sense signal can be used to activate a switch that will close S1 and S2, for example, a relay. Current sensing can be accomplished conveniently by using a sense resistor (RS) that is placed in series with the lamp T1 as shown in FIG. 5. Current through T1 can also be sensed by using a conventional current transformer (CT) as shown in FIG. 6 where the FIG. 5 and FIG. 6 sensing circuits may also be used in the other embodiments of the invention.

In an example of this first embodiment, assume L1=1.8 mH, L2=3.6 mH, C1=0.005 uF, C2=0.01 uF and fr=30 kHz. Accordingly, the natural resonance frequency of the (L1+L2) C1 combination or the L1 (C1+C2) combination is 30 kHz. Since for the 30 kHz excitation frequency, the impedance of C1 is 1.06 k ohm and the impedance of C2 is 530 ohms, it can be seen that the starting current can be effectively limited to value less than the maximum ratings of Q2 and Q3 of FIG. 2.

In a second embodiment of the invention, as also illustrated in FIG. 4, harmonic mode starting (at a harmonic (fn) of the fundamental fr of the excitation signal) but parallel resonance mode operation (at the fundamental frequency fr) are effected. In this case, $$1/2\pi\sqrt{(L1 + L2)\,C1} = fn$$

is utilized during starting where fn=n×fr. Depending on the values of (L1+L2) and C1, the natural resonance frequency of the circuit can be made equal to any higher harmonic frequency (fn) of the excitation frequency (fr).

During starting, the voltage C1 developed across C1 is dependent on the values of (L1+L2) and C1 and their quality. Thereby, the right value and quality components should preferably be selected. Examples of preferred components would Be polypropylene capacitors, as will be further discussed below.

In an example of this second embodiment, assume L1=1.9 mH, L2=1.2 mH, C1=0.001 uF, C2=0.012 uF, and fr=30 kHz. Accordingly, the natural resonance frequency of (L1+L2) C1 combination is 90 kHz. On the other hand, the natural resonance frequency of L1 (C1+C2) combination is 30 kHz.

Harmonic mode starting and resonant (fundamental) mode operation can also effected utilizing the circuitry of FIG. 7. In this third embodiment, $$fn = 1/2\pi\sqrt{(L1 \cdot C1)} \text{ and } fr = 1/2\pi\sqrt{(L1(C1 + C2)}$$

where S2 is open during starting and closed during operation of the lamp.

In a fourth embodiment of the invention, resonance mode starting and series resonance mode operation is shown in FIG. 8. In this case C1 is much much greater than C2, so that when considering C1 in series with C2, the effect of C1 can be neglected. Then, one can choose, $$fr = 1/2\pi\sqrt{(L1 + L2)} \quad C2 = 1/2\pi\sqrt{(L1 \cdot C1)}\ .$$

During starting, inductors L1 and L2 with C2 form the resonance circuit that resonates at the excitation frequency. After the lamp starts, the switch S1 closes, and L1 and C1 forms the resonant network. The effect of C2 can now be ignored where, in this mode, the lamp T1 is in series with C1 and L1. Since C2 can be made very small in value, current flow through through C2 (and thus power switches Q2 and Q3) can be kept very small. Moreover, during starting, the high impedance of C2 at fn is such that a firing voltage sufficient in magnitude to fire the lamp can readily be developed across this capacitor.

In an example, of this fourth embodiment, assume L1=1.8 mH, C1=0.015 uF, L2=4.72 mH, C2=0.0005 uF, and fr=30 kHz. C1 is 30 times higher than C2, thus, the capacitance offered by the C1 and C2 series combination is 0.00048 uF. The natural resonance frequency of 0.00048 uF and (L1+L2) is 90 kHz. On the other hand, the natural resonance frequency of L1 and C1 combination is 30 kHz.

Depending on the quality and the values of L1, L2, C1 and C2, FIG. 8 can also be arranged for: 1) resonance mode starting but non-resonance series operation, 2) harmonic mode starting but series resonance mode operation and 3) harmonic mode starting and non-resonance series operation.

Figure 9:
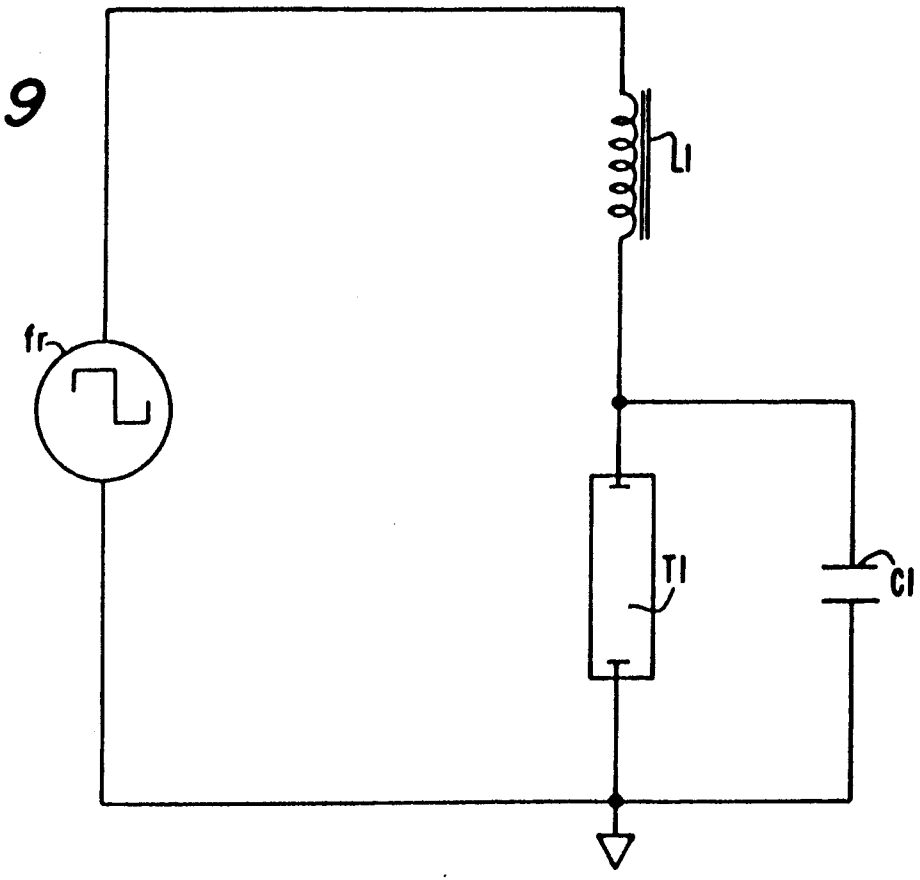
FIG. 9 is a circuit diagram of a further illustrative embodiment of the invention utilizing harmonic mode starting.

In a fifth and most preferred embodiment of the invention, harmonic mode starting and non-resonance operation are utilized as shown in FIG. 9. In this embodiment, $$fn = nxfr = 1/2\pi\sqrt{(L1 \cdot C1)}\ .$$

Thus, depending on the quality or Q-factor of the resonance inductor L1 and the resonance capacitor C1, during starting, voltage across C1 can be increased to a very high level by choosing low loss L1 and C1 and by resonating them at harmonics higher than the fundamental. That is, by keeping the excitation frequency (fr) fixed, the resonant network is so chosen that it resonates at the nth harmonic frequency, (fn).

Figure 10:
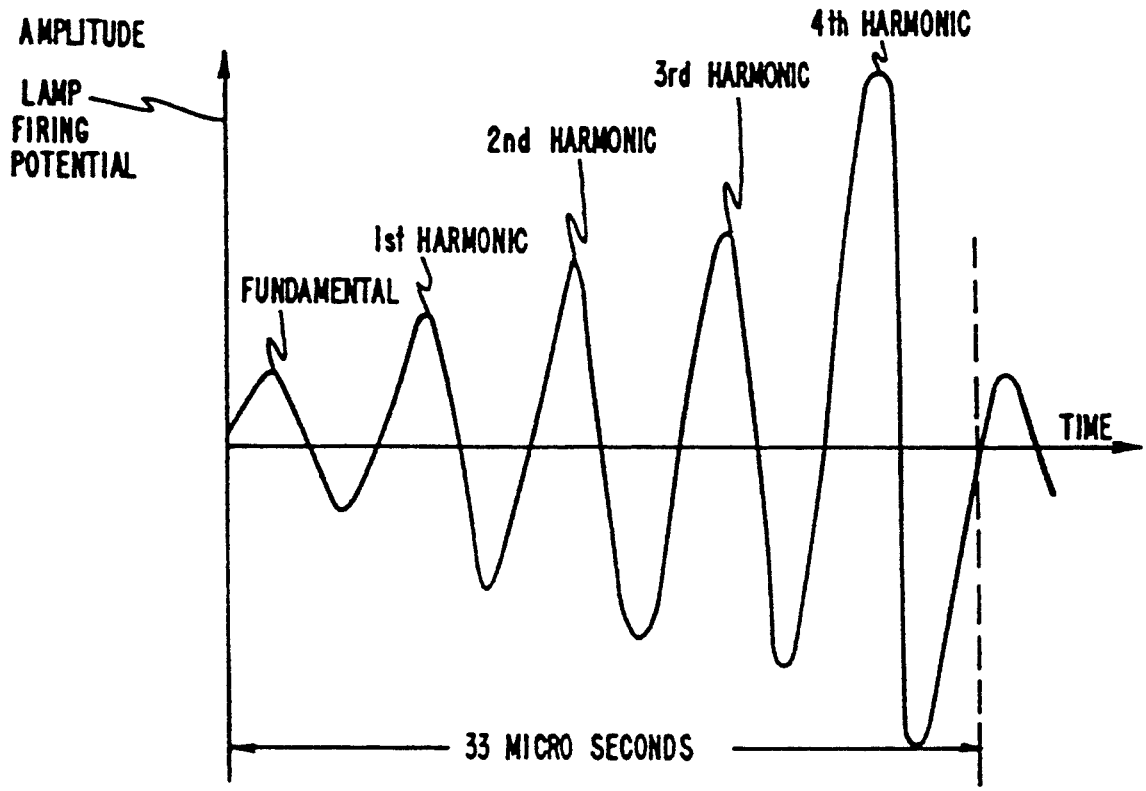
FIG. 10 is a graph of the ringing signal which will occur across the gas discharge lamp to effect the firing thereof in the circuitry of FIG. 9.
Figure 11:
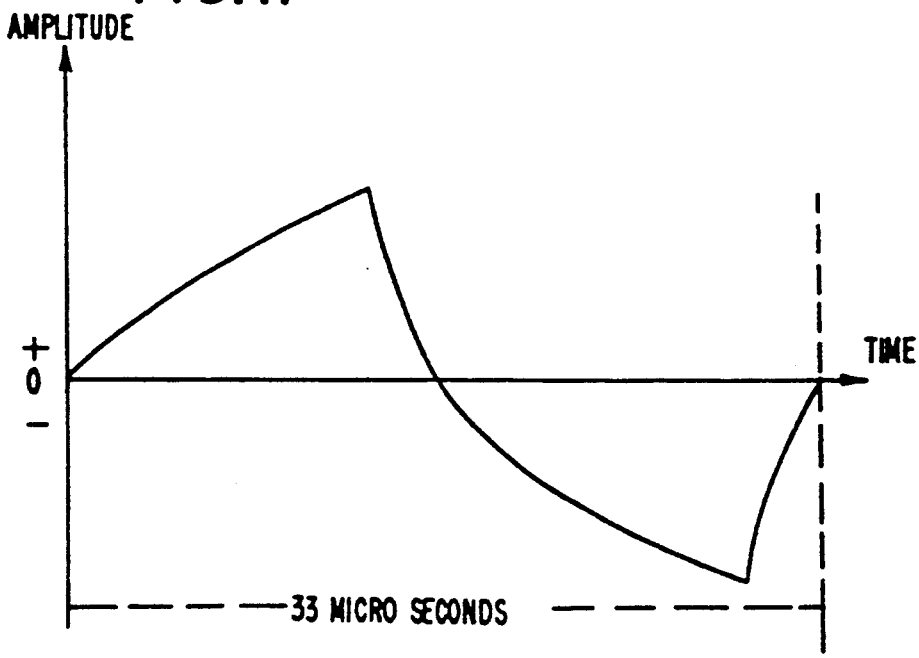
FIG. 11 is a graph of the voltage occurring across the gas discharge lamp of FIG. 9 during operation thereof—that is, after the firing thereof by the voltage waveform of FIG. 10.

As an example, this embodiment can be used in the circuit of FIG. 1 where the sensing circuits of FIGS. 5 or 6 are not required. Assume T1 is a commercially available 250 watt High Pressure Sodium (HPS) lamp. It typically requires approximately 2,500 peak voltage to start. Once the lamp is fired, the operating potential across the lamp is only 100 volts. Lamp firing voltage and operating voltage waveforms are shown in FIGS. 10 and 11. Let the excitation frequency fr=30,000 Hz and Vin=360 v. Then, for LR=0.26 mH and CR=0.0043 uf, the resonance frequency, $$fn = 1/2\pi\sqrt{(LR \cdot CR)} = 150{,}000 \text{ Hz},$$

which is the fourth harmonic of the fundamental frequency of 30,000 Hz.

As can be seen in FIG. 10, when the FIG. 9 circuit is excited with the fundamental frequency signal fr, the circuit will ring with the largest peak occurring at the natural resonant frequency of the circuit—that, is the fourth harmonic. Although the third harmonic peak does not exceed the lamp firing potential, the fourth harmonic does, as can be seen in FIG. 10, and of course fires the lamp.

Thus harmonic mode starting is advantageous because there is a rapid build-up of voltage such that at the natural (or resonant) frequency of the circuit, the lamp firing potential can be easily exceeded. Moreover, the circuit impedance is typically such in harmonic mode starting that the average power flow can be kept within the maximum rating of the power switches Q2, Q3, for example.

Thus, at the resonant frequency of 30 kHz of the excitation signal, the impedances are L1=49 ohms and C1=1.233 k ohms for the example given above for the FIG. 9 circuit. However, at 150 kHz the impedances of L1 and C1 are the same, namely, 245 ohms. In other words, since the natural resonance frequency of a 0.26 mH inductor and a 0.0043 uF capacitor combination is 150 k Hz, at the natural resonance frequency the impedance of L1 must be equal to the impedance of C1 so that they cancel each other. Thereby, in this example, when L1 and C1 are excited by a lower multiple of 150 kHz frequency source, that is a 30 kHz source, the excitation will result in various frequency contents over one 30 kHz frequency period. This is shown in FIG. 10. Note that the period of 30 kHz frequency is, 1/f=33.3 microsecond. The frequency content which includes 150 kHz frequency will have the highest amplitude because, at 150 kHz the impedance of LR is equal to CR but opposite in magnitude so that they cancel each other and thereby a large current can flow through the circuit. However, as can be seen from FIG. 10, this current flow occurs during only a fraction of one period of 33.3 microsecond. Thereby the average power flow per period is small.

Figure 12:
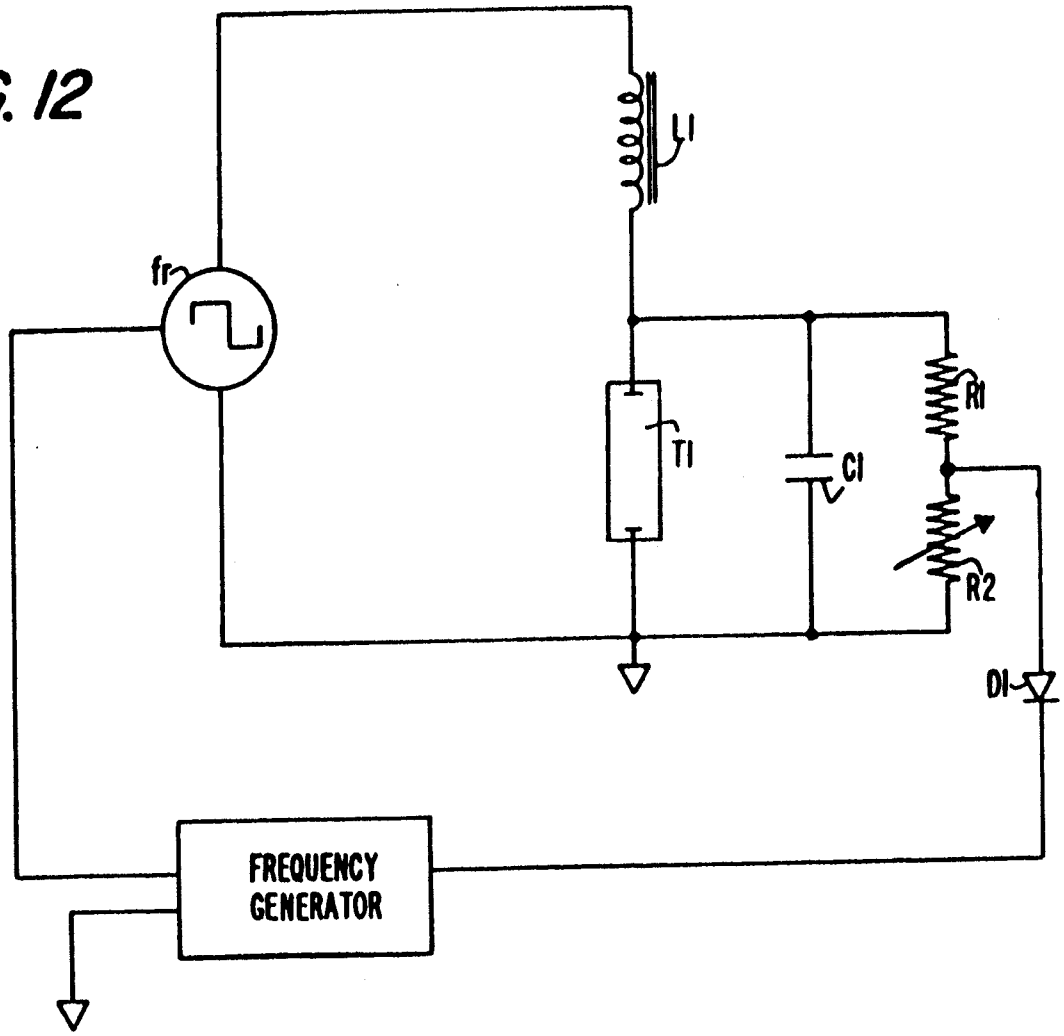
FIG. 12 is a circuit diagram of a further modification of the invention incorporating illustrative sense circuitry for sensing the voltage across the gas discharge lamp of the circuitry of FIG. 9.

The amount of current flow and thereby the voltage growth across C1 can be further controlled by incorporating a sense network as shown in FIG. 12. Accordingly, a high impedance resistor divider network (R1 and R2) placed across C1, senses voltage which is then rectified by the diode D1. This rectified signal can now be used to interrupt the frequency generator (SG2525 in FIG. 1) which generates fr. Such interruption of the frequency generator via the soft start pin is further described in the above-mentioned application entitled "Circuitry and Method for Limiting Current Between Power Inverter Output Terminals and Ground".

The Q-factor or the quality of the inductors and the capacitors should be good in order for harmonic mode starting to be effective not only in the embodiment of FIG. 9 but in the other harmonic mode starting embodiments. The quality of an inductor depends primarily on the magnetic core material, resistance of the winding, skin depth associated with the high frequency excitation, etc. Poorly designed high frequency inductors can cause core saturation, and excessive heat dissipation. On the other hand, the quality of a capacitor depends on its construction, such as, frequency response characteristic of the dielectric film, associated effective series resistance (ERS), leakage current characteristics, high frequency ripple current capability, etc. Also, the voltage that can be applied across a capacitor without dielectric breakdown varies with frequency. In this regard, a polypropylene capacitor would be preferred to a polyester capacitor, for example.

Thus starting (or firing) of the lamp occurs in an harmonic mode. The operation of the lamp in the FIG. 9 (or 10) embodiment after firing is effectively a non-resonant mode, since, upon lamp firing, most of the current through C1 switches to the path through the lamp. At this time, the inverter circuit is effectively constituted by the switches Q2 and Q3 and the series connected L1 and T1.

As described above, with respect to FIG. 4, other embodiments of the invention, after harmonic mode starting, switch to a resonance mode of operation after firing as opposed to the non-resonance mode of operation of FIG. 9. These other embodiments of the invention also realize the advantages of harmonic mode starting as described above with respect to FIG. 9.

What is claimed is:

1. Circuitry for starting and operating a gas discharge lamp, the operation of which is initiated in response to the voltage thereacross exceeding a predetermined value, said circuitry comprising:

an excitation signal source including inverter switching means for converting DC voltage to produce a high frequency alternating current excitation signal at a predetermined fundamental frequency for energizing the lamp;

reactance means responsive to the excitation signal and connected in circuit with the lamp, said reactance means including inductive means and capacitive means and having an initial natural resonant frequency at starting of the lamp, said initial natural resonant frequency being selected from the group consisting of the fundamental frequency and the second and higher harmonics of said fundamental frequency;

sensing means for sensing operation of the lamp; and switching means connected to said sensing means and said reactance means for varying the impedance of one of said inductive means and said capacitive means from a first nonzero value to a second nonzero value in response to the sensing means sensing initiation of the lamp operation, whereby said natural resonant frequency of said reactance means is changed form said initial value to a different value which is also selected from the group consisting of the fundamental frequency and the second and higher harmonics of said fundamental frequency.

2. Circuitry as in claim 1 wherein said different value of said natural resonant frequency is the same as said fundamental frequency of the excitation signal.

3. Circuitry as in claim 1 wherein said first value of the impedance of the reactance means is greater than said second value of said impedance to thus limit the current through the inverter switching means prior to initiation of operation of the lamp.

4. Circuitry as in claim 1 wherein the natural resonant frequency of the inductive and capacitive means, prior to initiation of the operation of the lamp, is a harmonic higher than the second harmonic of the fundamental frequency of said excitation signal.

5. Circuitry as in claim 1 wherein the natural resonant frequency of the inductive and capacitive means, prior to initiation of operation of the lamp, is the same as the fundamental frequency of the excitation signal.

6. Circuitry for starting and operating a gas discharge lamp, the operation of which is initiated in response to the voltage thereacross exceeding a predetermined value, said circuitry comprising:

an excitation signal source including inverter switching means for converting DC voltage to produce a high frequency alternating current excitation signal at a predetermined fundamental frequency for energizing the lamp;

reactance means responsive to the excitation signal connected in circuit with the lamp and including capacitive means and inductive means;

sensing means for sensing operation of the lamp; and switching means for changing the impedance of said reactance means from a first value to a second value in response to the sensing means sensing initiation of the lamp operation;

wherein said reactance means includes capacitive means and inductive means which, in combination, have a first natural resonant frequency prior to the operation of the switching means to change the impedance of the reactance means from said first value to said second value, and a second natural resonant frequency subsequent to the operation of the switching means, and where said first and second natural resonant frequencies are the same as said fundamental frequency of the excitation signal.

7. Circuitry for starting and operating a gas discharge lamp, the operation of which is initiated in response to the voltage thereacross exceeding a predetermined value, said circuitry comprising:

an excitation signal source including inverter switching means for converting DC voltage to produce a high frequency alternating current excitation signal at a predetermined fundamental frequency for energizing the lamp;

reactance means responsive to the excitation signal connected in circuit with the lamp;

sensing means for sensing operation of the lamp; and switching means for changing the impedance of said reactance means from a first value to a second value in response to the sensing means sensing initiation of the lamp operation;

wherein said reactance means includes capacitive means and inductive means which, in combination, have a first natural resonant frequency prior to the operation of the switching means to change the impedance of the reactance means from said first value to said second value, and a second natural resonant frequency subsequent to the operation of the switching means, and where said first natural resonant frequency of the reactance means is the same as one of the harmoonics of said fundamental frequency of the excitation signal and where the second natural resonant frequency of the reactance means is the same as said fundamental frequency of the excitation signal.

* * * * *